US007351130B1

(12) United States Patent
Chang

(10) Patent No.: US 7,351,130 B1
(45) Date of Patent: Apr. 1, 2008

(54) SANDING MACHINE HAVING ADJUSTABLE BRUSH

(76) Inventor: Wen Chi Chang, No. 48, Lane 276, Guanfu Rd., Sherngan Hsiang, Taichung Hsien 42951 (TW)

( * ) Notice: Subject to any disclaimer, the term of this patent is extended or adjusted under 35 U.S.C. 154(b) by 6 days.

(21) Appl. No.: 11/599,032

(22) Filed: Nov. 14, 2006

(51) Int. Cl.
*B24B 49/00* (2006.01)
*B24B 1/00* (2006.01)

(52) U.S. Cl. ..... 451/11; 451/65; 451/121

(58) Field of Classification Search ..... 451/11, 451/65, 188, 182, 178, 207, 131, 130, 177, 451/358, 57, 184, 120, 121, 124, 336
See application file for complete search history.

(56) References Cited

U.S. PATENT DOCUMENTS 82,780 A 10/1868 Wooster
5,361,544 A * 11/1994 Yang ..... 451/231
5,733,180 A * 3/1998 Kilde ..... 451/65
5,921,848 A * 7/1999 Zang et al. ..... 451/57
6,086,461 A * 7/2000 Williams et al. ..... 451/65
6,146,254 A 11/2000 Wang

* cited by examiner

*Primary Examiner*—Dung Van Nguyen
(74) *Attorney, Agent, or Firm*—Charles E. Baxley

(57) ABSTRACT

A sanding or polishing or grinding machine includes one or more sanding wheels supported on a machine base and movable up and down relative to the machine base for grinding the work pieces of different heights or thicknesses. A driving device may be used for driving the sanding wheels to move horizontally relative to the machine base for allowing the work pieces to be suitably sanded or ground by the sanding wheels. The sanding wheels are preferably disposed at different angular position relative to the machine base, for suitably sanding or grinding the work pieces in different angular positions.

10 Claims, 6 Drawing Sheets

SANDING MACHINE HAVING ADJUSTABLE BRUSH

BACKGROUND OF THE INVENTION

1. Field of the Invention

The present invention relates to a sanding or polishing or grinding machine, and more particularly to a sanding or polishing or grinding machine including one or more sanding or grinding wheels, wire brushes, rotatable brushes, bristle brushes, etc. rotatably supported on a machine base and disposed at different angular position relative to the machine base, for suitably sanding or grinding various work pieces.

2. Description of the Prior Art

Typical sanding or polishing machines comprise a table or platform disposed on a machine base for supporting various work pieces, and one or more sanding or grinding wheels, wire brushes, rotatable brushes, bristle brushes, etc. rotatably supported on the machine base, for sanding or grinding the work pieces.

For example, U.S. Pat. No. 82,780 to Wooster discloses one of the typical machines for scouring sheet metals and comprising two circular wire brushes rotatably supported on the machine base, for sanding or grinding or scouring the under and upper surfaces of the metal. Normally, the circular wire brushes are stationarily supported on the machine base and may not be adjusted to different angular position relative to the machine base such that the work pieces may only be sanded or ground or scoured in one direction and may not be suitably sanded or ground or polished by the circular wire brushes.

U.S. Pat. No. 6,146,254 to Wang discloses another typical sander machine comprising two or more different sander wheels, such as coarse and fine sander wheels for suitably sanding or grinding or polishing the work pieces.

However, the sander wheels are also stationarily supported on the machine base and may not be adjusted to different angular position relative to the machine base such that the work pieces may only be sanded or ground or scoured in one direction and may not be suitably sanded or ground or polished by the sander wheels. In addition, the sander wheels of the typical sander machine also may not be moved or adjusted up and down relative to the machine base such that the sander wheels may not be provided for suitably sanding or grinding or polishing the work pieces of different heights or thicknesses.

The present invention has arisen to mitigate and/or obviate the afore-described disadvantages of the conventional sanding or polishing machines.

SUMMARY OF THE INVENTION

The primary objective of the present invention is to provide a sanding or polishing or grinding machine including one or more sanding or grinding wheels, wire brushes, rotatable brushes, bristle brushes, etc. rotatably supported on a machine base and disposed at different angular position relative to the machine base, for suitably sanding or grinding various work pieces.

The other objective of the present invention is to provide a sanding or polishing or grinding machine including one or more sanding or grinding wheels movable up and down relative to the machine base for grinding the work pieces of different heights or thicknesses.

In accordance with one aspect of the invention, there is provided a machine comprising a machine base, at least one sanding wheel supported on the machine base, a moving device for moving the sanding wheel up and down relative to the machine base, and a driving device for driving the sanding wheel to move horizontally relative to the machine base.

The machine base includes at least one carrier slidably disposed thereon and movable up and down relative to the machine base, and the moving device includes a threaded member vertically disposed on the machine base and threaded with the carrier for allowing the carrier and the sanding wheel to be moved up and down relative to the machine base.

The machine base includes at least one guide rail vertically disposed thereon, the carrier is slidably attached onto the guide rail. The moving device includes a motor driving device coupled to the threaded member for allowing the threaded member to be rotated by the motor driving device in order to move the carrier and the sanding wheel up and down relative to the machine base.

The driving device includes at least one guide track horizontally attached to the carrier for slidably supporting the sanding wheel, and a first motor driving device for moving the sanding wheel along the guide track. The driving device includes at least one seat slidably engaged onto the guide track for supporting the sanding wheel, and coupled to the first motor driving device.

The seats each include an arm extended therefrom for supporting the sanding wheel. The driving device includes a lever pivotally coupled to the seat with a pivot pin, and coupled to the first motor driving device with a crank. The driving device includes a second motor driving device disposed on the seat and coupled to the sanding wheel for driving the sanding wheel.

The sanding wheel is rotatably attached to the carrier with a spindle, and the carrier includes a motor driving device disposed thereon and coupled to the spindle of the sanding wheel for rotating the sanding wheel. The machine base includes a conveyer device disposed thereon for supporting work pieces.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
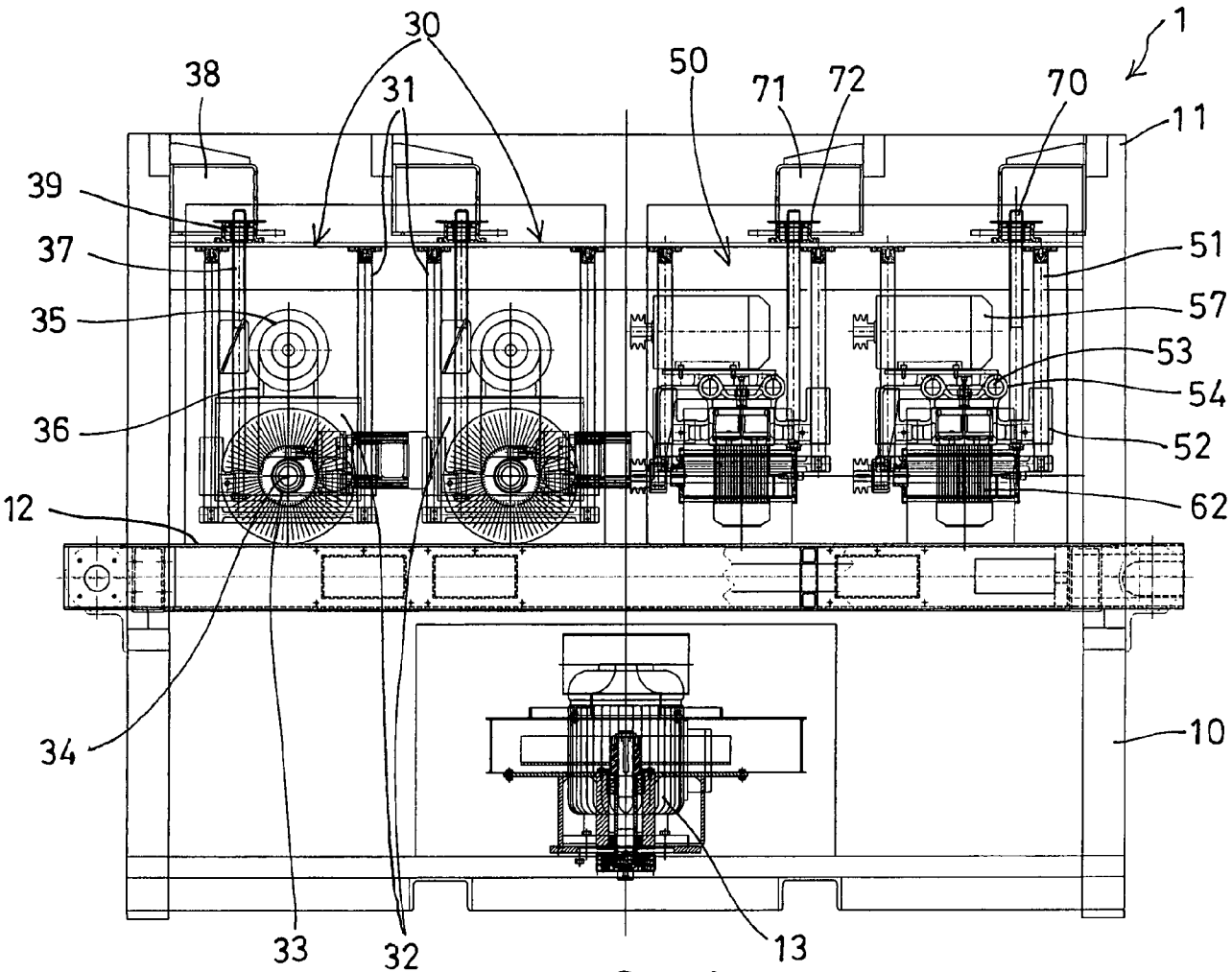
FIG. 1 is a front plan schematic view of a sanding or polishing or grinding machine in accordance with the present invention.

Referring to the drawings, and initially to FIGS. 1-5, a sanding or polishing or grinding machine 1 in accordance with the present invention comprises a machine base 10, a frame or housing 11 disposed on top of the machine base 10, a conveyer belt or device 12 disposed on top of the machine base 10 and preferably disposed below the housing 11 for supporting and conveying various work pieces through the upper portion of the machine base 10, and one or more motor driving devices 13 disposed in the machine base 10 and coupled to the conveyer belt or device 12 for moving or driving the conveyer device 12 and thus for conveying and moving the work pieces laterally or sidewise through the upper portion of the machine base 10.

Figure 2:
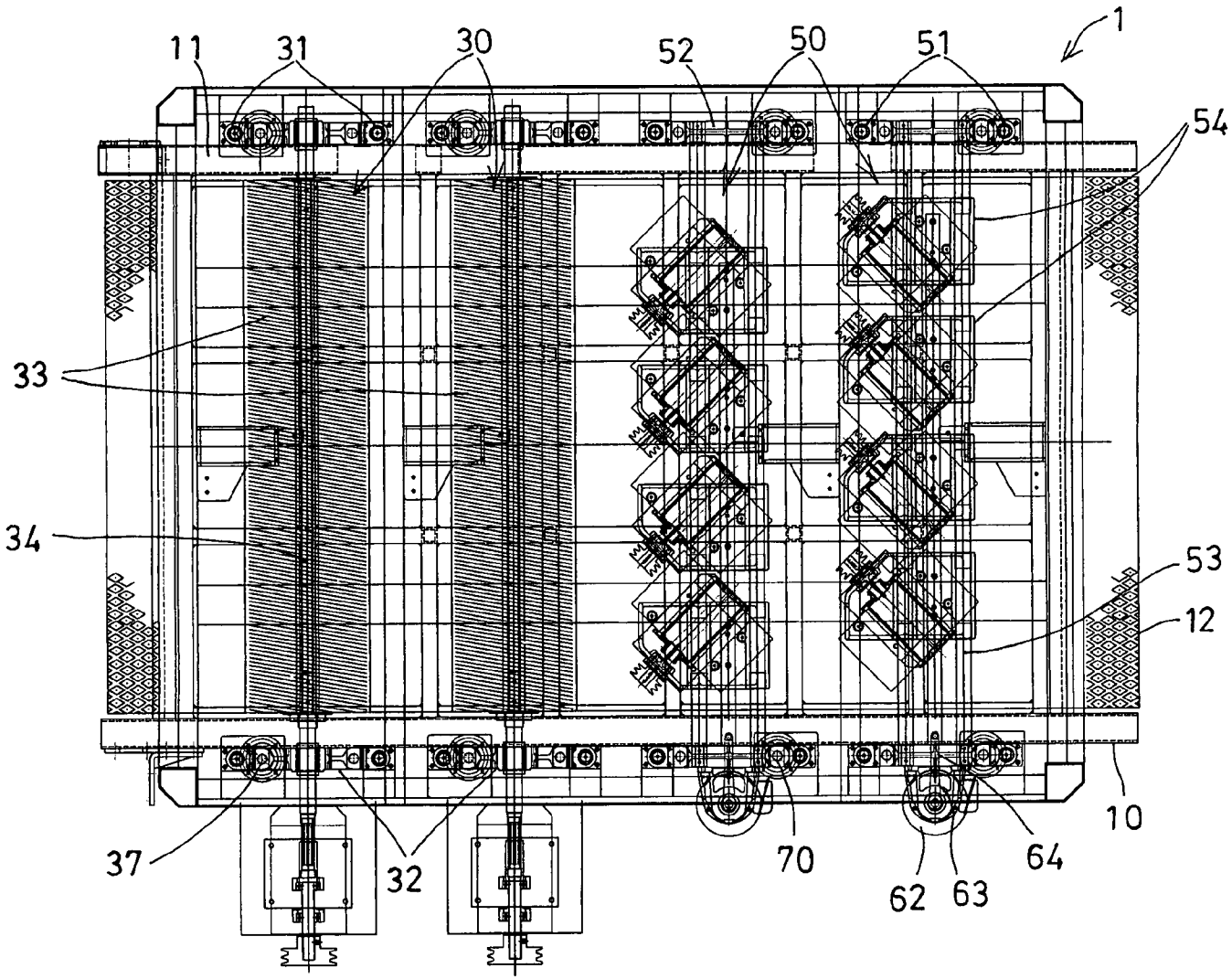
FIG. 2 is a top plan schematic view of the sanding or polishing or grinding machine.

One or more sanding or polishing or grinding devices 30, 50 are disposed in the housing 11 and movable up and down relative to the housing 11 and the machine base 10 and the conveyer device 12 for suitably sanding or polishing or grinding the work pieces. For example, as shown in FIGS. 1 and 2, the sanding or polishing or grinding devices 30 each include one or more (such as two) guide rails 31 vertically disposed in each of the front and the rear portions of the housing 11, and one or more (such as two) carriers 32 slidably attached to the guide rails 31 and movable up and down relative to the housing 11 and the machine base 10 and the conveyer device 12, and a sanding or grinding or polishing wheel or brush 33 having a spindle 34 rotatably supported on the carriers 32 for allowing the sanding wheel 33 to be moved up and down relative to the housing 11 and the machine base 10 and the conveyer device 12.

A motor driving device 35 is disposed on each of the carriers 32 and coupled to the spindle 34 of the respective sanding wheel 33 with such as a gearing device, a sprocket-and-chain coupling device, or a pulley-and-belt coupling device 36 for allowing the sanding wheel 33 to be rotated or driven by the motor driving device 35. A moving means or device, such as a track or bolt or threaded member 37 may further be provided and vertically disposed in the housing 11 and coupled to or threaded with the respective carrier 32 for allowing the carrier 32 and thus the sanding wheel 33 to be moved up and down relative to the housing 11 and the machine base 10 and the conveyer device 12 by the threaded member 37.

Another motor driving device 38 is disposed on the housing 11 and coupled to the threaded member 37 with such as a gearing device, a sprocket-and-chain coupling device, or a pulley-and-belt coupling device 39 for allowing the threaded member 37 to be rotated or driven by the motor driving device 38 and thus for allowing the carrier 32 and the sanding wheel 33 to be moved up and down relative to the housing 11 and the machine base 10 and the conveyer device 12 by the motor driving device 38 with the threaded member 37, such that the sanding wheel 33 may be moved or adjusted up and down relative to the work pieces and may thus be used to machine or to work on the work pieces of different heights or thicknesses.

As shown in FIGS. 1-7, the other sanding or polishing or grinding devices 50 each also include one or more (such as two) guide rails 51 vertically disposed in each of the front and the rear portions of the housing 11, and one or more (such as two) carriers 52 slidably attached to the guide rails 51 and movable up and down relative to the housing 11 and the machine base 10 and the conveyer device 12, and one or more (such as two) guide tracks 53 horizontally attached or coupled to or straddled between the carriers 52, and one or more (such as four) seats 54 slidably engaged or attached onto the guide tracks 53 and each having an arm 55 extended downwardly therefrom for attaching or supporting another sanding or grinding or polishing wheel or brush 56 for allowing the sanding wheel 56 to be moved up and down relative to the housing 11 and the machine base 10 and the conveyer device 12 together with the carriers 52 and the guide tracks 53.

A further motor driving device 57 is disposed on each of the seats 54 and coupled to the respective sanding wheel 56 with such as a gearing device, a sprocket-and-chain coupling device, or a pulley-and-belt coupling device 58 for allowing the sanding wheel 56 to be rotated or driven by the motor driving device 57. A lever 60 is disposed above and between the guide tracks 53 and parallel to the guide tracks 53 and pivotally coupled to the seats 54 with such as pivot pins 61 respectively (FIG. 5) for allowing the seats 54 and the sanding wheel 56 to be moved along the guide tracks 53 in concert with each other. A still further motor driving device 62 is disposed or attached onto one of the carriers 52 and includes a crank 63 attached thereto for directly coupling to the lever 60 or indirectly coupling to the lever 60 with a link 64 for allowing the seats 54 and the sanding wheel 56 to be moved along the guide tracks 53 in reciprocating action with the motor driving device 62.

Another moving means or device, such as a track or bolt or threaded member 70 may further be provided and vertically disposed in or attached to the housing 11 and disposed between or parallel to the guide rails 51 and coupled to or threaded with the respective carrier 52 for allowing the carrier 52 and thus the seats 54 and the sanding wheel 56 to be moved up and down relative to the housing 11 and the machine base 10 and the conveyer device 12 by the threaded member 70. A still further motor driving device 71 is disposed on the housing 11 and coupled to the threaded member 70 with such as a gearing device, a pulley-and-belt coupling device or a sprocket-and-chain coupling device 72 for allowing the threaded member 70 to be rotated or driven by the motor driving device 71 and thus for allowing the carrier 52 and the sanding wheel 56 to be moved up and down relative to the housing 11 and the machine base 10 and the conveyer device 12 by the motor driving device 71 with the threaded member 70.

Figure 3:
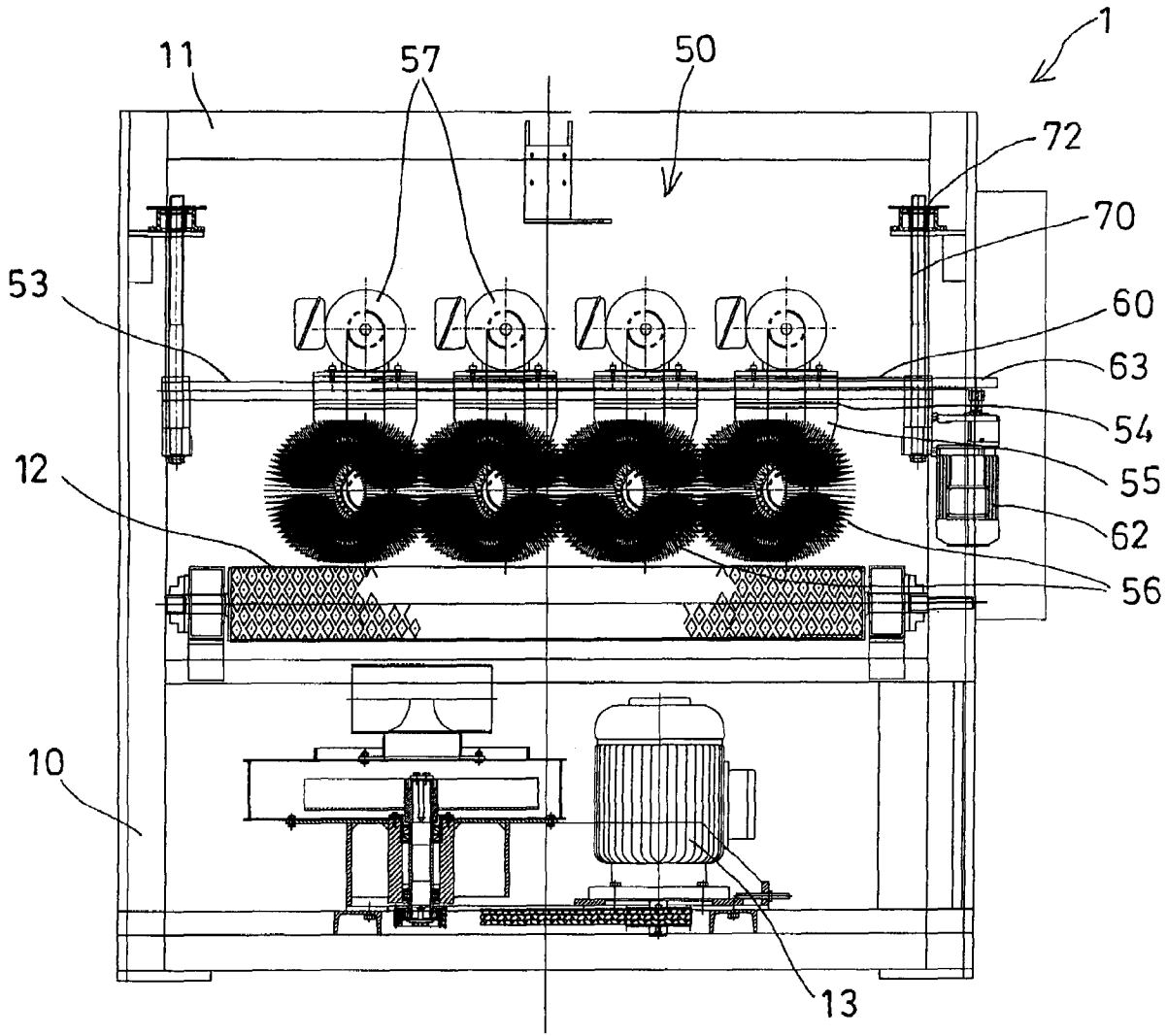
FIG. 3 is a side plan schematic view of the sanding or polishing or grinding machine.
Figure 4:
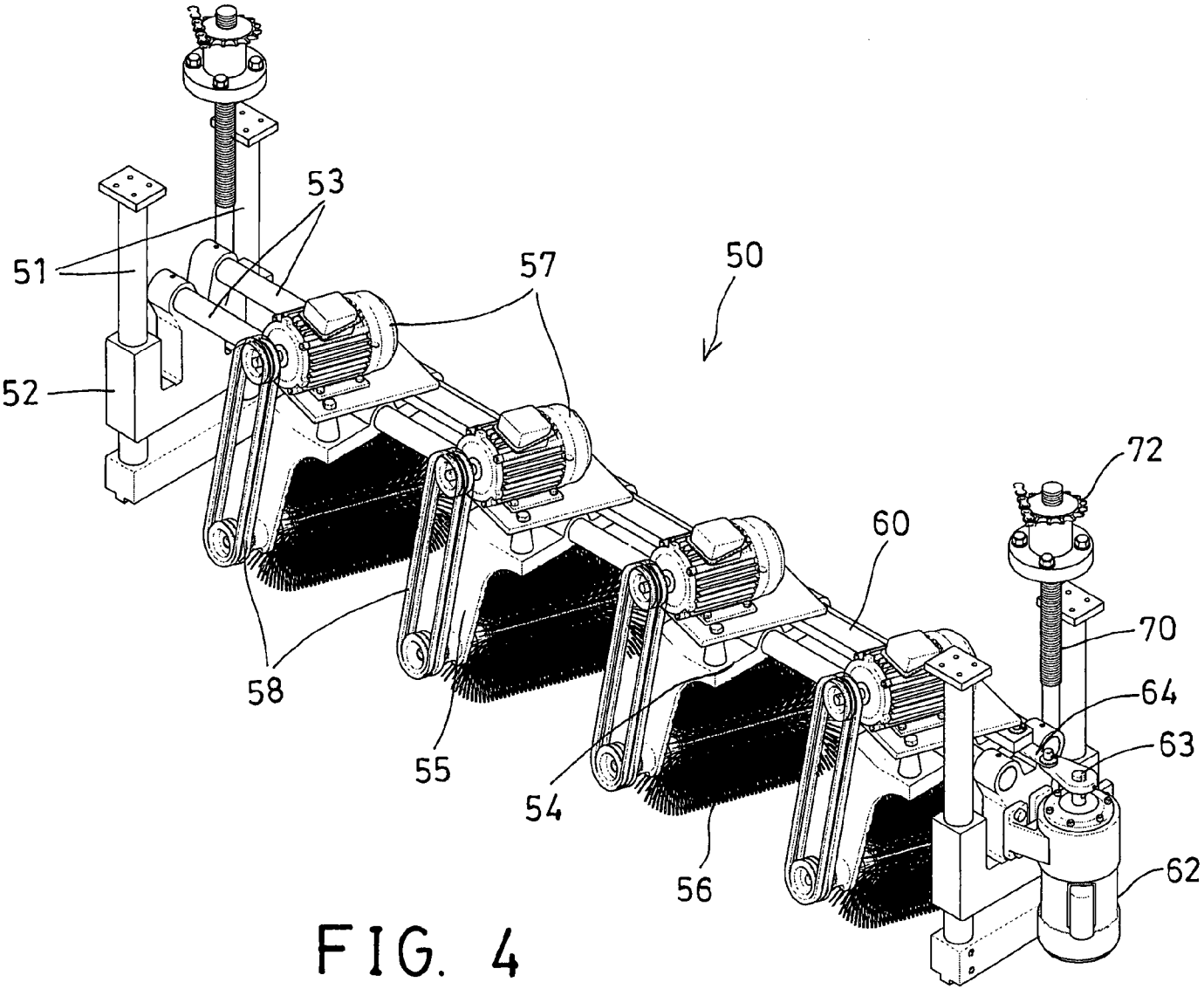
FIG. 4 is a perspective view illustrating a portion of the sanding or polishing or grinding machine.
Figure 5:
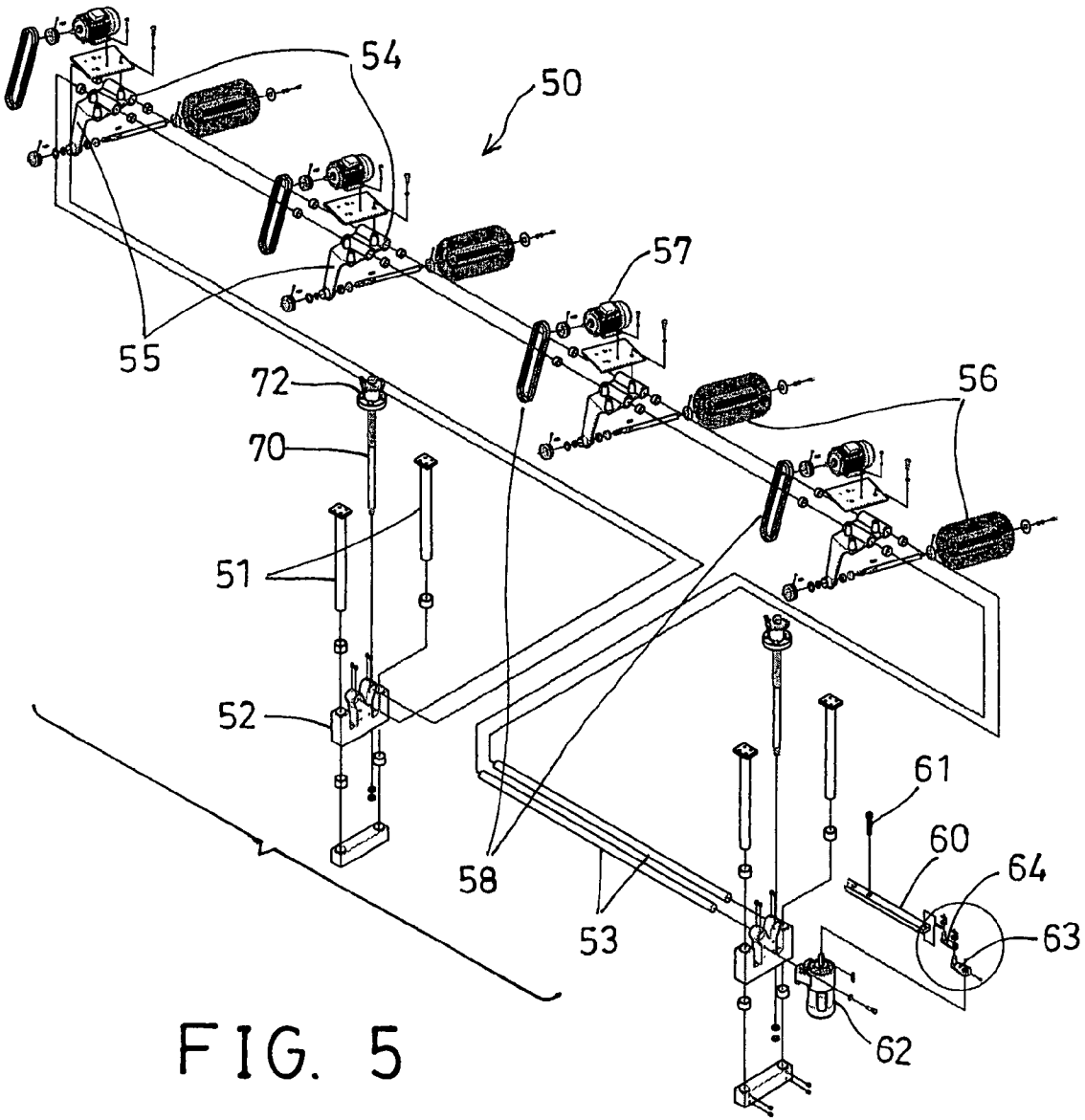
FIG. 5 is a partial exploded view of the sanding or polishing or grinding machine.
Figure 7:
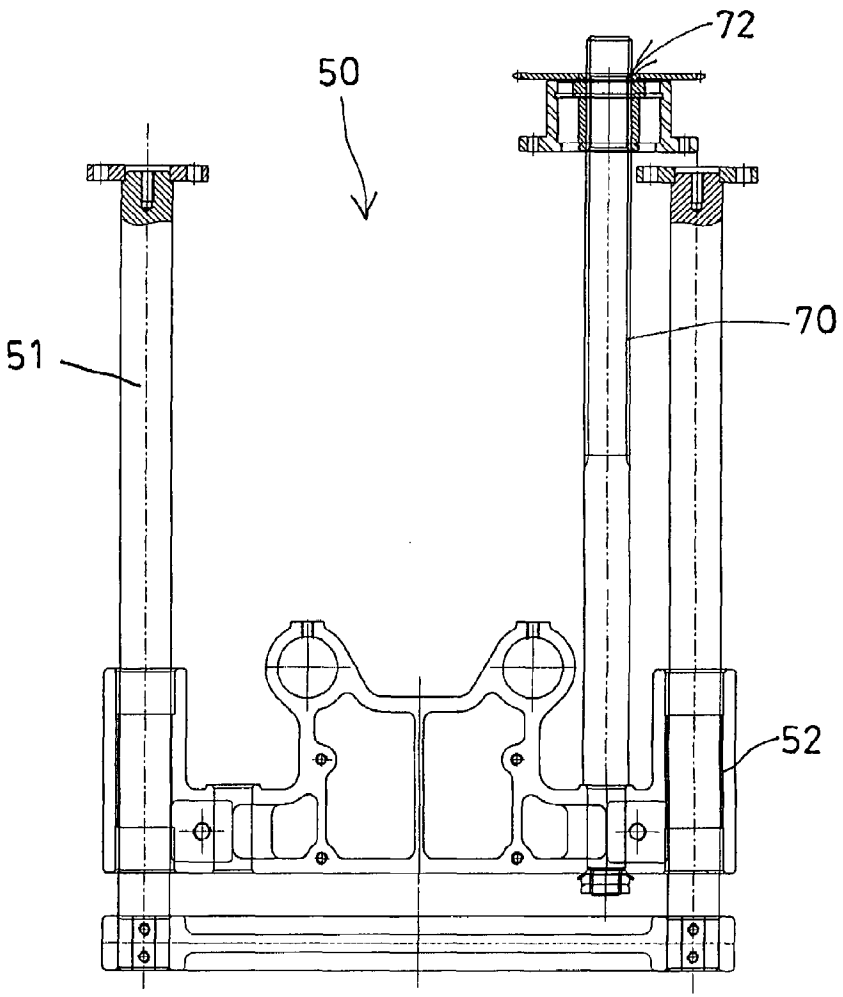
FIG. 7 is a partial plan schematic view illustrating a portion of the sanding or polishing or grinding machine.
Figure 6:
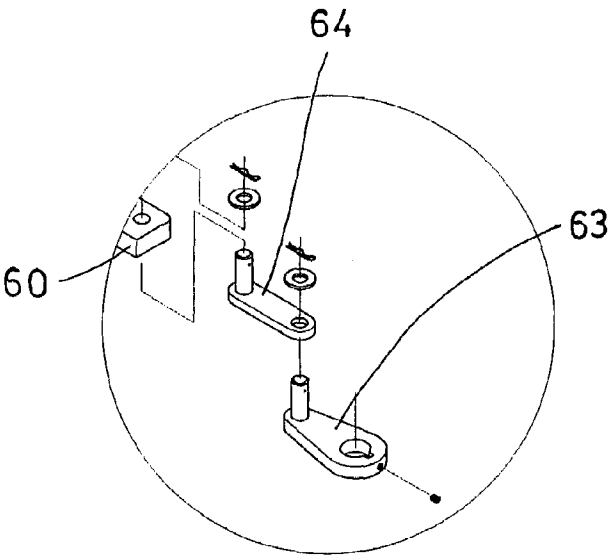
FIG. 6 is an enlarged partial exploded view of the sanding or polishing or grinding machine.

The sanding wheel 56 may also be adjusted up and down to machine the work pieces of different heights or thicknesses. As best shown in FIGS. 2 and 3, the sanding wheels 56 are horizontally supported above the machine base 10 and inclined relative to the work piece moving direction, and the sanding wheels 56 of different sanding devices 50 are preferably disposed or arranged in different angular position relative to the work pieces and the machine base 10 and the conveyer device 12 for suitably sanding or grinding the work pieces in different angular position. In addition, the sanding wheels 56 may further be moved along the guide tracks 53 in reciprocating action by the motor driving device 62 for further suitably sanding or grinding the work pieces.

It is to be noted that the sanding wheels 33, 56 may be selected from the typical sanding or grinding wheels, wire brushes, rotatable brushes, bristle brushes, etc., such as the wheels or brushes made up of a number of long flexible bristles or cloth fibers which are simultaneously thrown outwardly into a generally cylindrical configuration as the wheel or the brush is rotated about its longitudinal axis. The sanding wheels 33, 56 may be used for suitably sanding or grinding the work pieces in different angular position and are excellent for sanding or grinding the wooden work pieces having a spatial or three-dimensional patterns or carvings or sculptures formed thereon. The typical sanding or polishing machines failed to provide a brush or sanding wheel 33, 56 that may be moved up and down and simultaneously that may be moved longitudinally or laterally or sidewise or horizontally relative to the housing 11 and the machine base 10 and the conveyer device 12.

Accordingly, the sanding or polishing machine includes one or more sanding or grinding wheels, wire brushes, rotatable brushes, bristle brushes, etc. rotatably supported on a machine base and disposed at different angular position relative to the machine base, for suitably sanding or grinding various work pieces.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A machine comprising:

a machine base including at least one carrier slidably disposed thereon and movable up and down relative to said machine base, at least one sanding wheel horizontally supported on said machine base and inclined relative to a work piece moving direction, means for moving said at least one sanding wheel up and down relative to said machine base, said moving means including a threaded member vertically disposed on said machine base and threaded with said at least one carrier for allowing said at least one carrier and said at least one sanding wheel to be moved up and down relative to said machine base, and means for driving said at least one sanding wheel to move horizontally relative to said machine base.

2. The machine as claimed in claim 1, wherein said machine base includes at least one guide rail vertically disposed thereon, said at least one carrier is slidably attached to said at least one guide rail.

3. The machine as claimed in claim 1, wherein said moving means includes a motor driving device coupled to said threaded member for rotating said threaded member to move said at least one carrier and said at least one sanding wheel up and down relative to said machine base.

4. The machine as claimed in claim 1, wherein said driving means includes at least one guide track horizontally attached to said at least one carrier for slidably supporting said at least one sanding wheel, and a first motor driving device for moving said at least one sanding wheel along said at least one guide track.

5. The machine as claimed in claim 4, wherein said driving means includes at least one seat slidably engaged onto said at least one guide track for supporting said at least one sanding wheel, and coupled to said first motor driving device.

6. The machine as claimed in claim 5, wherein said seats each include an arm extended therefrom for supporting said at least one sanding wheel.

7. The machine as claimed in claim 5, wherein said driving means includes a lever pivotally coupled to said at least one seat with a pivot pin, and coupled to said first motor driving device with a crank.

8. The machine as claimed in claim 5, wherein said driving means includes a second motor driving device disposed on said at least one seat and coupled to said at least one sanding wheel for driving said at least one sanding wheel.

9. The machine as claimed in claim 1, wherein said at least one sanding wheel is rotatably attached to said at least one carrier with a spindle, and said at least one carrier includes a motor driving device disposed thereon and coupled to said spindle of said at least one sanding wheel for rotating said at least one sanding wheel.

10. The machine as claimed in claim 1, wherein said machine base includes a conveyer device disposed thereon for supporting work pieces.

* * * * *